United States Patent [19]

Ponomarev

[11] Patent Number: 4,997,551

[45] Date of Patent: Mar. 5, 1991

[54] CONCENTRATION FOR BENEFICIATING MINERALS

[76] Inventor: Grigory M. Ponomarev, ulitsa Skuridina, 8, kv. 14, Magadan, U.S.S.R.

[21] Appl. No.: 449,861

[22] PCT Filed: Apr. 27, 1988

[86] PCT No.: PCT/SU88/00100

§ 371 Date: Dec. 26, 1989

§ 102(e) Date: Dec. 26, 1989

[87] PCT Pub. No.: WO89/10195

PCT Pub. Date: Nov. 2, 1989

[51] Int. Cl.[5] ..... B03B 5/02

[52] U.S. Cl. ..... 209/445; 209/44; 209/435; 209/485; 209/503

[58] Field of Search ..... 209/44, 445, 446, 451, 209/485, 503, 504, 435, 436, 444, 480, 505

[56] References Cited

U.S. PATENT DOCUMENTS

| | | | |
|---|---|---|---|
| 829,493 | 8/1906 | Thurston | 209/445 |
| 1,286,111 | 11/1918 | Robertson | 209/435 |
| 4,162,969 | 7/1979 | Lagal | 209/447 |
| 4,273,648 | 6/1981 | Legg | 209/447 |

FOREIGN PATENT DOCUMENTS

| | | | |
|---|---|---|---|
| 741940 | 7/1980 | U.S.S.R. | 209/446 |
| 700975 | 6/1983 | U.S.S.R. . | |
| 809692 | 6/1983 | U.S.S.R. . | |
| 3847 | of 1873 | United Kingdom | 209/446 |

*Primary Examiner*—Donald T. Hajec

*Attorney, Agent, or Firm*—Fleit, Jacobson, Cohn, Price, Holman & Stern

[57] ABSTRACT

A concentrator comprises a beneficiating member (1) in the form of a bowl with a tapered bottom (2) a concavity of which is provided with a discharge hole (13), and a drive mechanism (5) a hollow drive shaft (8) of which accommodates eccentrically a shaft (10) carrying the beneficiating member (1) executing a circular movement about a radius equal to the eccentricity. In cross section the bowl is elliptical and is connected to a base (3) by flexible elements (12), whereas the concavity of the tapered bottom (2) is offset relative to its shaft (10). A tray (14) for finally concentrating the material is provided under the discharge hole (13).

4 Claims, 3 Drawing Sheets

CONCENTRATION FOR BENEFICIATING MINERALS

FIELD OF THE INVENTION

This invention relates generally to the mining industry, and more particularly to a concentrator for beneficiating minerals by gravity.

BACKGROUND OF THE INVENTION

For obtaining reliable results of sample processing a highly accurate sample cleaning procedure must be followed to ensure that during rinsing the sample water could not entrain some of the sample material. With this aim in view, the base of the concentrator should be set strictly horizontally. Taking into account the fact that one of the major advantages of the concentrator is amenability to mounting on the wing of a drilling rig operating in locations with rugged terrain, it is impossible to position the concentrator horizontally and therefore obtain reliable sample test results.

There are known rotary separator (concentrators) for beneficiating minerals, particularly gold, operating on the principle of concentrating heavy metals or minerals, and comprising a base with a hub, and a beneficiating member with a discharge hole mounted on a shaft of the drive mechanism.

The drive mechanism is fashioned as a hollow drive shaft journalled in bearings in the base hub and accommodating with an eccentricity on bearings a shaft of the beneficiating member rotating about a circle of a radius equal to the eccentricity. The beneficiating member has the form of a bowl provided with riffles at the inner surface thereof, and the discharge ports. The separator also has a breaking mechanism in the form of brake disks, a system of levers and elements closing the discharge ports in the bottom.

However, accurate cleaning of the sample requires here that the base of the separator be positioned strictly horizontally. In addition, washing the concentrate from the space between the riffles when using hard-to-wash materials necessitates stopping of the separator and thorough cleaning of the riffles, which makes the washing process labour- and time-consuming.

SUMMARY OF THE INVENTION

It is an object of the present invention to provide a concentrator for beneficiating minerals of such a construction as to obviate the washing procedure, while enabling to obtain reliable results under any operating conditions of the concentrator and affording a reduction in the time consumed for treating the sample and amount of labour consumed for the process.

The object is attained by that in a concentrator for beneficiating minerals comprising a beneficiating member in the form of a bowl with a tapered bottom a concavity of which has a discharge hole, a base with a hub, and a drive mechanism including a hollow drive shaft journalled in bearings in the base hub, the hollow drive shaft accommodating eccentrically in bearings a shaft of the beneficiating member executing a circular movement about a radius equal to the eccentricity, according to the invention, the bowl has an elliptical cross section and is connected to the base by flexible elements, whereas the concavity of the tapered bowl bottom is offset relative to the bowl shaft, a tray for finishing concentration being accommodated on the bowl under the discharge hole of the concavity.

The elliptical shape of the beneficiating member and the offset concavity increase the travel path of the material being beneficiated, and thereby improve conditions for settling of the material at the bottom of the beneficiating member. As distinct from the prototype, the concentrate is discharged continuously by sliding to the concavity, which reduces the time for processing the sample and makes the procedure less labour consuming. The aforedescribed allows to dispense with washing as a separate operation.

Securing the beneficiating member, viz., the bowl, to the base by means of flexible elements prevents this member against rotation about its own axis to result in that the member moves about a circle of a radius equal to the eccentricity in a jolting manner. All the elements of the beneficiating member are immovable relative to each other, whereas the material of the sample moves in a jolting fashion about the perimeter of the bowl. This movement facilitates separation of the material according to density.

The tray secured on the bowl under the discharge hole serves to increase the degree of concentration, since in conjunction with the bowl it executes jolting motions to result in separation of the material according to density.

Preferably, provided over the tray and under the discharge hole of the bowl bottom is a mixing chamber communicating with the bowl and having a discharge hole, the flow area of the discharge hole of the bowl being smaller than the flow area of the discharge hole of the mixing chamber. The mixing chamber can additionally communicate with the bowl through a perforated pipe disposed at the bottom of the bowl, or through a meshed overflow port provided at the top of the side wall of the bowl. Such an arrangement provides that the liquid phase of pulp separated in the course of beneficiation is conveyed to the mixing chamber to thereby additionally liquify the solid phase of the concentrate entering the mixing chamber through the discharge hole of the bowl and result in improved material separation.

In view of the aforegoing, while being structurally simple, the concentrator according to the invention reduces the amount of time and labour consumed for the process of sample treatment and dispenses with cleaning the riffles due to that the jolt-like movement of the beneficiating member causes the material to slide along the tapered bottom of the bowl to the discharge hole of its concavity.

BRIEF DESCRIPTION OF THE DRAWINGS

The invention will now be described in greater detail with reference to the specific embodiments thereof taken in conjunction with the accompanying drawings, in which.

BEST MODE OF CARRYING OUT THE INVENTION

Figure 1:
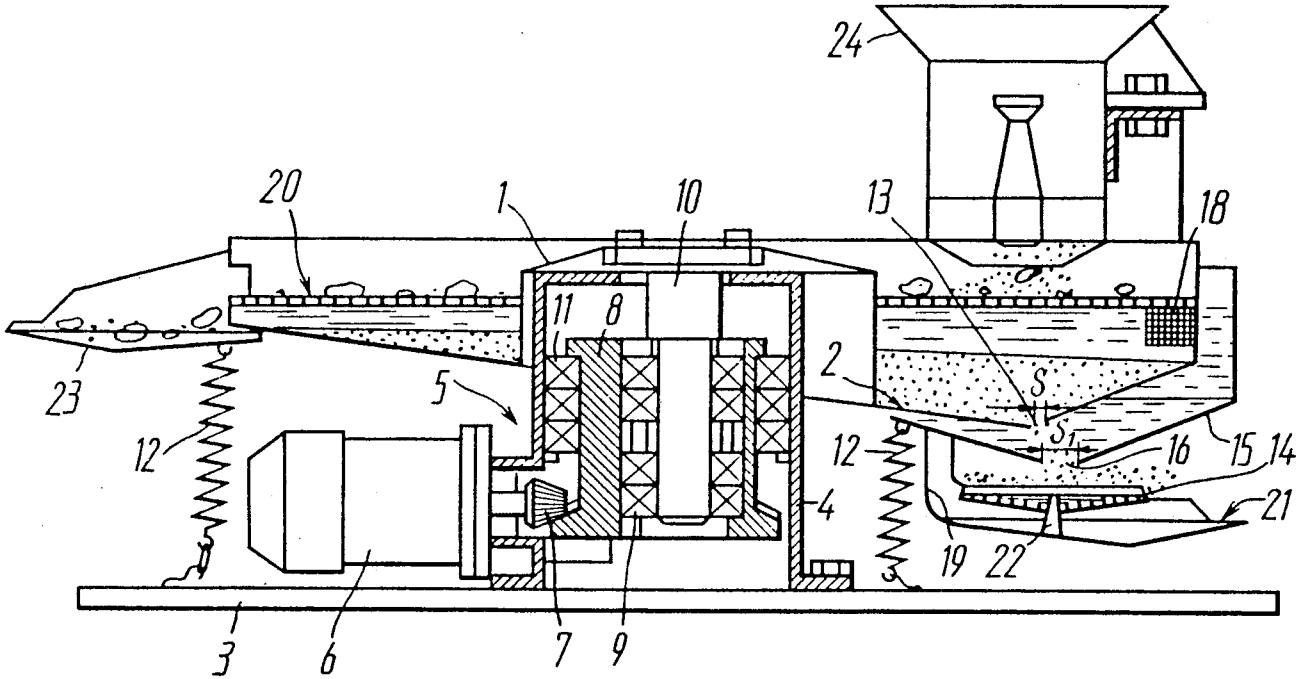
FIG. 1 is a partially sectional view of a concentrator according to the invention.

A concentrator for beneficiating minerals comprises a beneficiating member 1 (FIGS. 1,2) in the form of a bowl with a tapered bottom 2, a base 3 with a hub 4, and a drive mechanism 5 including an electric motor 6, a gear transmission 7 (FIG. 1), and a hollow drive shaft 8 in which a shaft 10 carrying the beneficiating member 1 is arranged with an eccentricity on bearings 9.

The hollow drive shaft 8 is journalled in bearings 11 in the hub 4 of the base 3. Such an arrangement allows the bowl to move about a circle of a radius equal to the eccentricity e.

Figure 2:
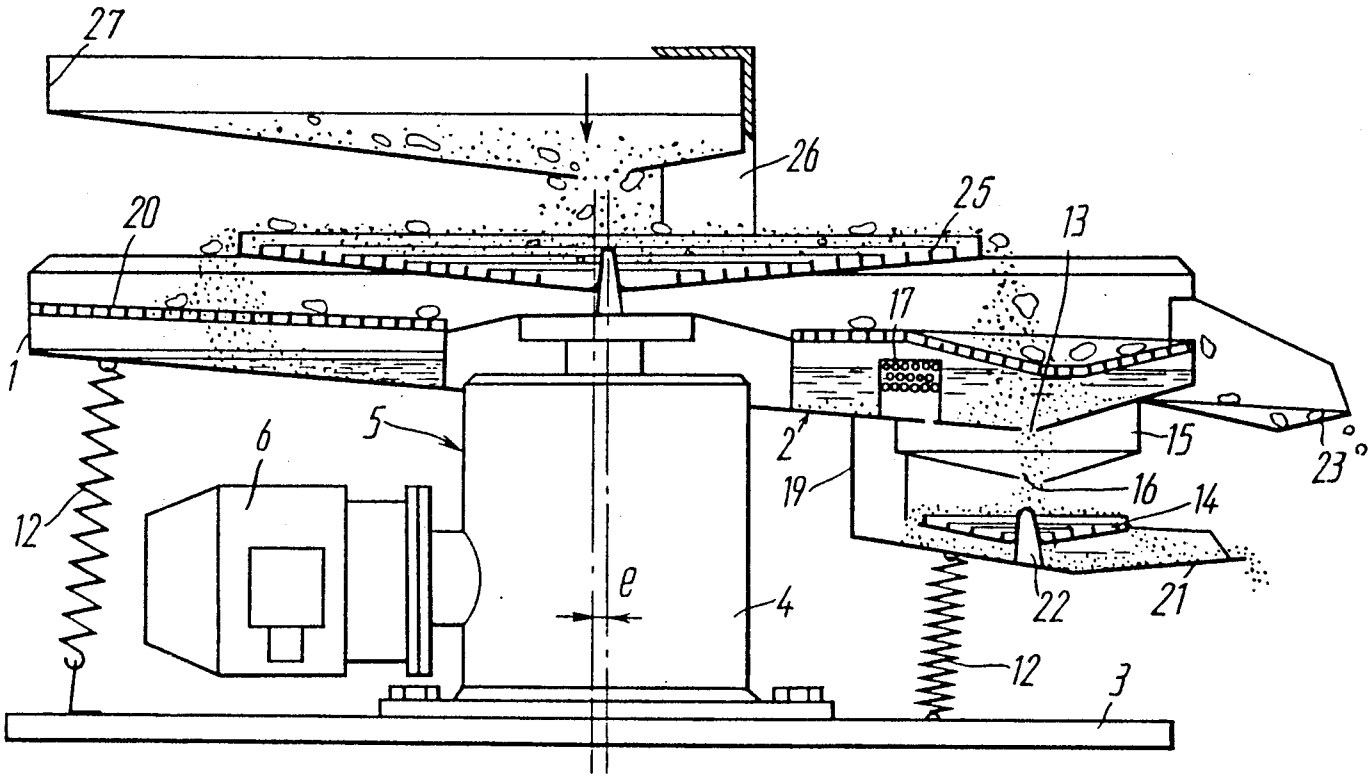
FIG. 2 is an alternative modification of the concentrator.
Figure 3:
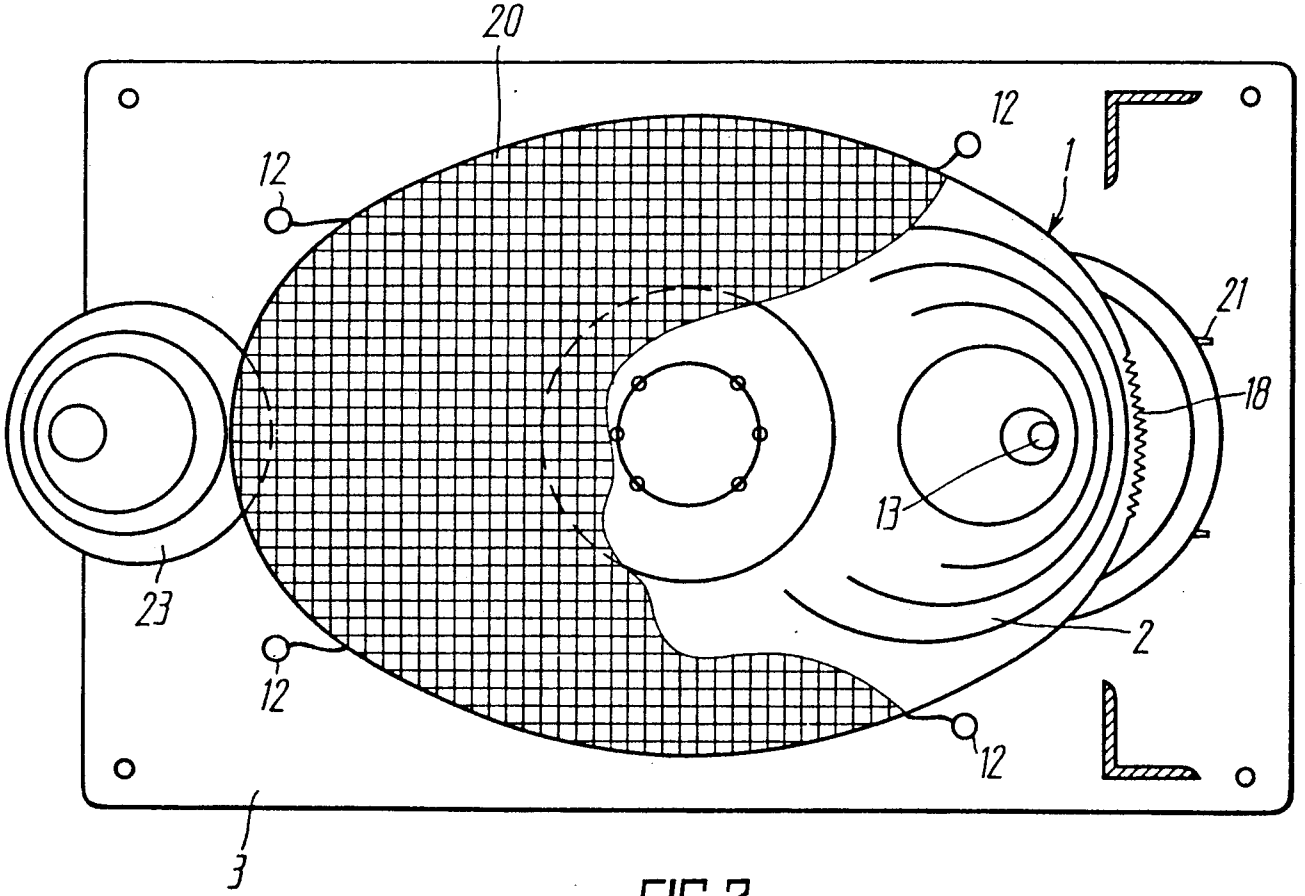
FIG. 3 is a top view of the concentrator.

The beneficiating member 1 has a substantially elliptical cross section, as seen best in FIG. 3, and is connected to the base 3 by flexible elements 12 (FIGS. 1, 2), such as springs or cables, whereby while moving about a circle the bowl executes intermittent jolting motion.

A discharge hole 13 is provided in the recess of the tapered bottom 2 of the bowl, the concavity of the tapered bottom 2 of the bowl being offset relative to the shaft 10 of the bowl, as shown in FIGS. 1 to 3.

A tray 14 intended for retreatment of the concentrate is disposed under the discharge hole 13 of the bowl; several such trays can be provided one above the other (not shown).

Provided between the concavity of the tapered bottom 2 of the bowl and tray 14 under the discharge hole 13 of the bowl bottom is a mixing chamber 15 having a discharge hole 16, the flow areas of the discharge hole 13 of the bottom 2 being smaller than the flow areas, of the discharge hole 16 of the chamber 15.

The chamber 15 communicates with the interior of the bowl through a perforated pipe 17 (FIG. 2) secured at the bottom 2 of the bowl, and through the discharge hole 13, as shown in FIG. 2, or through a meshed overflow port 18 (FIG. 1) provided at the top part of the bowl side wall.

The beneficiating member 1 (bowl) has a bracket 19 at its underside, and is enclosed at the top by a grid 20. Provided a under the tray 14 at the bracket 19 is an end tray 21 with a rod 22 thereof carrying the tray 14. One more tray 23 is provided at the outer side of the bowl on its side wall to entrap coarse fraction of the material.

The material is fed through a discharge means 24 of a drill pipe string (FIG. 1), when the concentrator is mounted on a drilling rig. In the second embodiment shown in FIG. 2 a tapered tray having riffles is provided above the grid 20, a charging hopper 27 overlying this tray 25 being affixed to a frame 26.

The proposed concentrator operates in the following manner.

The electric motor 6 (FIG. 1) is energized, whereby rotation is transmitted through the gear transmission 7 (bevel gears) to the hollow shaft 8 and beneficiating member 1 secured on the shaft 10 arranged eccentrically in the hollow shaft 8.

The shaft 10 and the beneficiating member 1 secured thereon execute a circular movement about a radius equal to the eccentricity. Because this movement is braked by the flexible elements 12 (springs), rotation of the beneficiating member about its own axis is prevented, whereas the circular movement becomes intermittent and jolting. The material is fed from the discharge means 24 onto the grid 20 with water, and under the jolting action of the beneficiating member 1 the large size fraction of the material rolls off the grid 20 to the tray 23 and is thereby separated, whereas the gange is thrown off the grid.

The material falling through the grid 20 enters the bowl of the beneficiating member 1. Jolting and circular motion of the beneficiating member 1 causes the material to be distributed according to its density and lowered to the concavity of the tapered bottom of bowl 2, whereas water tends to remain at the top of the bowl. Part of the material of higher density is conveyed through the discharge hole 13 to the mixing chamber 15 under the member 1. At the same time, the separated water flows through the overflow port 18 to the chamber 15 to mix at the bottom of the chamber 15 with the dense mass of the material, and fluidize this material for the thus fluidized material to freely flow through the discharge port 16 (having a flow area larger than the flow are of the discharge port 13) to the tray 14 where the concentration process is finalized.

In the tray 14 the material is additionally beneficiated; a lighter material is discharged with water to the end tray 21, whereas heavy particles of the material tend to collect at the bottom of the tray and the light particles are dumped.

Because the tray 14 is freely placed on the rod 22 of the end tray 21, it is possible to remove this tray 14 at the end of sample treatment and replace it with a clean tray, whereas the concentrate is thoroughly washed off the removed tray 14.

Provision of the beneficiating member with an additional tray for executing final concentration makes it possible to treat bore mud without supplying extra amounts of water to the final concentration tray to result in a substantially reduced consumption of water for processing a sample in the field conditions.

INDUSTRIAL APPLICABILITY

The invention can be used with success for processing mining samples of gravel deposits, for small-scale mining of gold, platinum, silver and other metals and minerals of a density over 5 g/cm$^3$, and for increasing the degree of concentration attained by other dressing equipment, such as dredges, ore washers, etc.

I claim:

1. A concentrator for beneficiating minerals comprising: a beneficiating member (1) in the form of a bowl with a tapered bottom (2) including a discharge portion having a discharge hole (13), a base (3) having a hub (4), and a drive mechanism (5) including a hollow drive shaft (8) journalled in bearings (11) in the hub (4) and having a shaft (10) which is secured with an eccentricity in bearings (9) said shaft carrying the beneficiating member (1), said beneficiating member executing a circular movement about a circle of a radius equal to the eccentricity, characterized in that the bowl of the beneficiating member (1) has an elliptical cross section in a plane generally perpendicular to the drive shaft and said bowl is connected to the base (3) by flexible elements (12), the concavity of the tapered bowl bottom (2) being offset relative to the shaft (10) carrying this bowl, and a tray (14) for receiving concentrate being disposed under the discharge hole (13).

2. A concentrator as claimed in claim 1, characterized in that there is provided a mixing chamber (15) disposed over the tray (14) and under the discharge hole (13) of the bowl bottom (2), this mixing chamber (15) communicating with the bowl and having a discharge hole (16), the flow area of the discharge hole (13) of the bowl being smaller than the flow area of the discharge hole (16) of the mixing chamber (15).

3. A concentrator as claimed in claim 2, characterized in that the mixing chamber (15) is additionally communicated with the bowl through a perforated pipe (17) disposed at the bottom (2) of the bowl.

4. A concentrator as claimed in claim 2, characterized in that the mixing chamber (15) is additionally communicated with the bowl through a meshed overflow port (18) provided at the top part of the side wall of the bowl.

* * * * *